United States Patent [19]

Wright et al.

[11] Patent Number: 5,022,865

[45] Date of Patent: Jun. 11, 1991

[54] HERMETICALLY SEALING CONNECTOR AND METHOD OF USE THEREOF

[75] Inventors: James R. Wright, Guilford; James R. Hall, Bainbridge; Keith D. Theobald, Sidney, all of N.Y.

[73] Assignee: Simmonds Precision Products, Inc., Wilmington, Del.

[21] Appl. No.: 370,943

[22] Filed: Jun. 23, 1989

Related U.S. Application Data

[62] Division of Ser. No. 244,199, Sep. 14, 1988, Pat. No. 4,871,328.

[51] Int. Cl.[5] ..... H01R 13/52

[52] U.S. Cl. ..... 439/279; 439/368; 439/639; 439/901

[58] Field of Search ..... 439/279-299, 439/301, 350, 367, 369, 638, 639, 892, 902

[56] References Cited

U.S. PATENT DOCUMENTS 2,619,515 11/1952 Doane ..... 439/279

4,708,663 11/1987 Eckart ..... 439/901

*Primary Examiner*—P. Austin Bradley

*Attorney, Agent, or Firm*—Dale R. Lovercheck

[57] ABSTRACT

A connector device and method of use thereof provide positioning and hermetic sealing of electrical contacts in protective housings. The housings protect wires which connect the speed sensor of a turbine engine to a display. The connector supports the electrical contacts in an electrical insulator. The connector includes a malleable flange which is adapted to be hermetically sealed between two housings which protect wires connected to the speed sensor in the turbine engine. The flange is hermetically sealed between a tongue on one housing and a groove in the other housing. The sealing flange extends radially from the central axis of the connector and is compressed by the tongue of a releasable housing into the groove of a permanent housing to form a hermetic seal. The flange supports the electrical insulator which holds electrically conducting inner contacts in position to be slideably mounted into outer contacts which are supported by the connector housing.

19 Claims, 10 Drawing Sheets

HERMETICALLY SEALING CONNECTOR AND METHOD OF USE THEREOF

This application is a division, of application Ser. No. 07/244,199, filed Sept. 14, 1988 now U.S. Pat. No. 4,871,328.

The invention relates to the hermetic sealing of connectors between housings. More particularly, the invention provides replaceable hermetically sealing connectors, which support electrical contacts, and are useful for connecting high temperature turbine engine speed sensors to a display. Also provided is a cable connector backshell (sleeve) which is adapted to hold a cable to the housings which support the contacts. The sleeve, the hermetically sealing connector and method of use thereof in accordance with the invention are provided for efficient maintenance of turbine engine speed sensing systems. Such sensors operate within or near the high pressure combustion chamber of turbine engines. The wires from the sensor initially pass within a conduit which must be hermetically sealed to maintain the pressure of the engine. The wires from the sensor are in electrical contact with the cable to a counter and a display for monitoring engine speed. For maintenance of the wires, which may have been previously misconnected or damaged, the conduit must be disconnected from the cable. Hermetic sealing of the conduit is readily obtained by using replacement connectors in accordance with the invention. The hermetically sealing replaceable connector includes a collar having a sealing flange. The collar supports an insulator which holds at least one electrical contact in position. The sealing flange is compressed by the tongue of a releasably mounted housing (or shell) into the groove of a permanently mounted housing (or backshell) to form a hermetic seal.

It is an object of the invention to provide a readily replaceable electrically insulated connector which is hermetically sealable at high temperatures and pressures. It is an object of the invention to provide a method of hermetically sealing an electrical contact in a housing positioned adjacent to a turbine engine. It is an object of the invention to provide a sleeve for connecting a cable to housings which support hermetically sealed electrical contacts.

The prior art does not provide readily replaceable hermetically sealable connectors for use at high temperatures. Evans, in U.S. Pat. No. 4,108,529, discloses an electrical feed through device for connecting electric components on a bulkhead. The device is not disclosed as being useful at high temperatures. A part of the dielectric body is physically deformed to effect a hermetic seal with the conductive sleeve and/or electrical conductor. By contrast, the present invention, by virtue of the tongue-and-groove features, provides a dual edge seal which does not deform the dielectric. The dual edges are on the mating faces of the shell and back shell. This feature provides control of the amount of crush to limit the shearing action, thereby preventing breakthrough. The dielectric is a rather brittle ceramic in a preferred embodiment of the present invention. Such a dielectric would crack if it were crushed as disclosed by Evans. The seal of the invention is made by providing a flange of a ductile metal, such as nickel, which is brazed to the dielectric. Evans seals individual conductors rather than an insert of multiple conductors as is provided by the present invention.

Mattingly, Jr., in U.S. Pat. No. 4,509,814, discloses an electrical connector shell assembly. The connector shells of Mattingly do not include a hermetically sealing tongue or groove in sealing surfaces adjacent to the sealing flange. Further, the sealing flange of Mattingly does not support an insulator or a contact as does the sealing flange of the present invention.

Stuart, in U.S. Pat. No. 3,200,366, discloses an annular ring which is deformed to seal an electrical connector. However, the ring of Stuart does not support an insulator or a contact as does the sealing flange disclosed herein in accordance with the present invention.

Willis, in U.S. Pat. No. 3,861,774, discloses a ground stud assembly. The assembly has a single contact surface in the path of flow of the ground current. The base is coined to form a mating cavity to receive the head of the stud at an upstanding flange around the cavity which is later squeezed over onto the head of the stud to secure it in place. Willis neither provides support for an electrical contact, which is insulated from the housing, nor hermetic sealing. The present invention provides a device and a method by which a hermetically sealing electrical contact is replaced thereby allowing wiring to be serviced to replace damaged seals or contacts. The present invention provides a hermetic connector which may be opened (i.e.: to reassign contact and circuit relationships) and then resealed hermetically without replacing expensive parts. This provides cost effective servicing in which no machining, welding or brazing is required, and the risk of damaging the engine, sensor or cable is minimized.

References relating to the connector sleeve of the invention include Martin et al., U.S. Pat. No. 1,954,088, which discloses a lock coil; Locati, U.S. Pat. No. 4,685,761, which discloses an electrical contact assembly and method of assembly; Wahl, U.S. Pat. No. 3,137,925, which discloses a method of splicing insulated conductors and O'Keefe et al., U.S. Pat. No. 3,323,098, which discloses a sub-miniature coaxial connector.

BRIEF DESCRIPTION OF THE DRAWINGS

The several drawings are described briefly as follows.

BRIEF DESCRIPTION OF THE INVENTION

Figure 1:
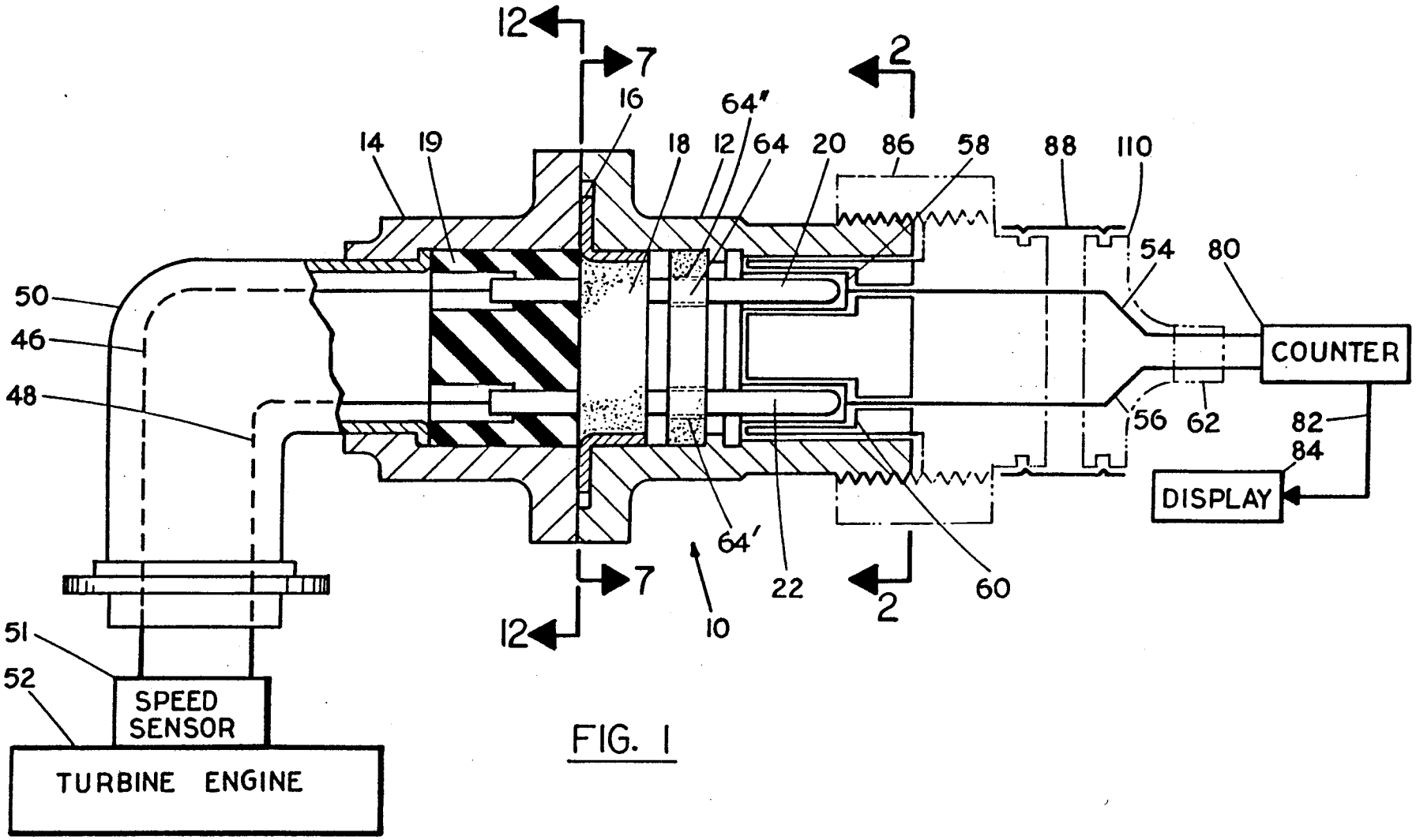
FIG. 1 is a cross-sectional side view of a connector assembly in accordance with the invention.

A connector device and method of use thereof provide positioning and hermetic sealing of electrical contacts in protective housings. The housings protect wires which connect the speed sensor of a turbine engine to a display. The connector supports the electrical contacts in an electrical insulator. The connector includes a collar having a malleable flange which is adapted to be hermetically sealed between two housings which protect wires connected to the speed sensor in the turbine engine. The flange is hermetically sealed between a tongue on one housing and a groove in the other housing. The sealing flange extends radially from the central axis of the collar and is compressed by the tongue of a releasable housing into the groove of a permanent housing to form a hermetic seal. The collar, thus held by its sealing flange to the housings, supports the electrical insulator which holds electrically conducting inner contacts in position to be slideably mounted into outer contacts which are supported by a mating connector which is coupled to the releasable housing.

DETAILED DESCRIPTION OF THE INVENTION

With more particular reference to the drawings, a preferred embodiment of the invention is shown in FIGS. 1 through 15 wherein the same numeral refers to the same item in each of the several figures. With more particular reference to FIG. 1, a connector assembly in accordance with the present invention is shown at 10. The connector assembly 10 is adapted to maintain sealing during turbine engine operation. The connector assembly 10 includes a releasable sealing housing 12, sometimes referred to as a connector shell, and a permanently mounted sealing housing 14, sometimes referred to as a backshell. Hermetically sealed between the releasable housing 12 and the permanent housing 14 is connector 15. The flange 16 extends radially from the collar 17 which supports the electrical insulator (or dielectric material), 18. The insulator 18, which preferably is made of ceramic and is disc shaped, supports the inner contacts 20, 21, 22 and 23.

The flange 24 of the releasable housing 12 includes the tongue 26. The releasable housing 12 includes stepwise grooves 28, 30 and 32 circumferentially around its outer body. Flange 34 of permanent housing 14 includes the groove 36.

In the assembled position, as shown in FIG. 1, the groove 36 of flange 34 fits over the tongue 26 of flange 24. The keys 18″ (shown in FIG. 13) of the housing 100 are adapted to slide within and be guided by keyways 18′ (shown in FIG. 2) of the releasable housing 12. The keys 18″ and keyways 18′ are held in alignment, and are adapted to position the inner contacts 20 and 22 through apertures 64′ and 64″ in insulator 64 and into the outer contacts 58 and 60. Bolts or screws are inserted through apertures 38, 40, 42 and 44 of flange 34 and are tighted into the threaded passages 70, 71, 72 and 73 of flange 24. The bolts or screws through apertures 38, 40, 42 and 44, hold the tongue 26 in the groove 36 with the flange 16 compressed therebetween, thereby hermetically sealing the releasable housing 12 to the permanent housing 14.

Conductors 46 and 48 are enclosed by conduit 50 and extend into resilient insulator 19 and are connected to inner contacts 20 and 22. During maintenance operations, the resilient insulator 19 is pressed into housing 14 to expose the ends of conductors 46 and 48 for connection to inner contacts 20 and 22. Conductors 46 and 48 are connected to the speed sensor 51. The speed sensor 51 is connected to the turbine engine 52.

Conductors 54 and 56 are connected to the outer contacts 58 and 60. Conductors 54 and 56 are enclosed in cable 62. Nut 86 connects the housing 12 to the cable sleeve 88. The outer contacts 58 and 60 engage inner contacts 20 and 22. The inner contacts 20 and 22 extend through the insulators 18 and 64. Insulator 64 is supported by releasable housing 12.

Figure 2:
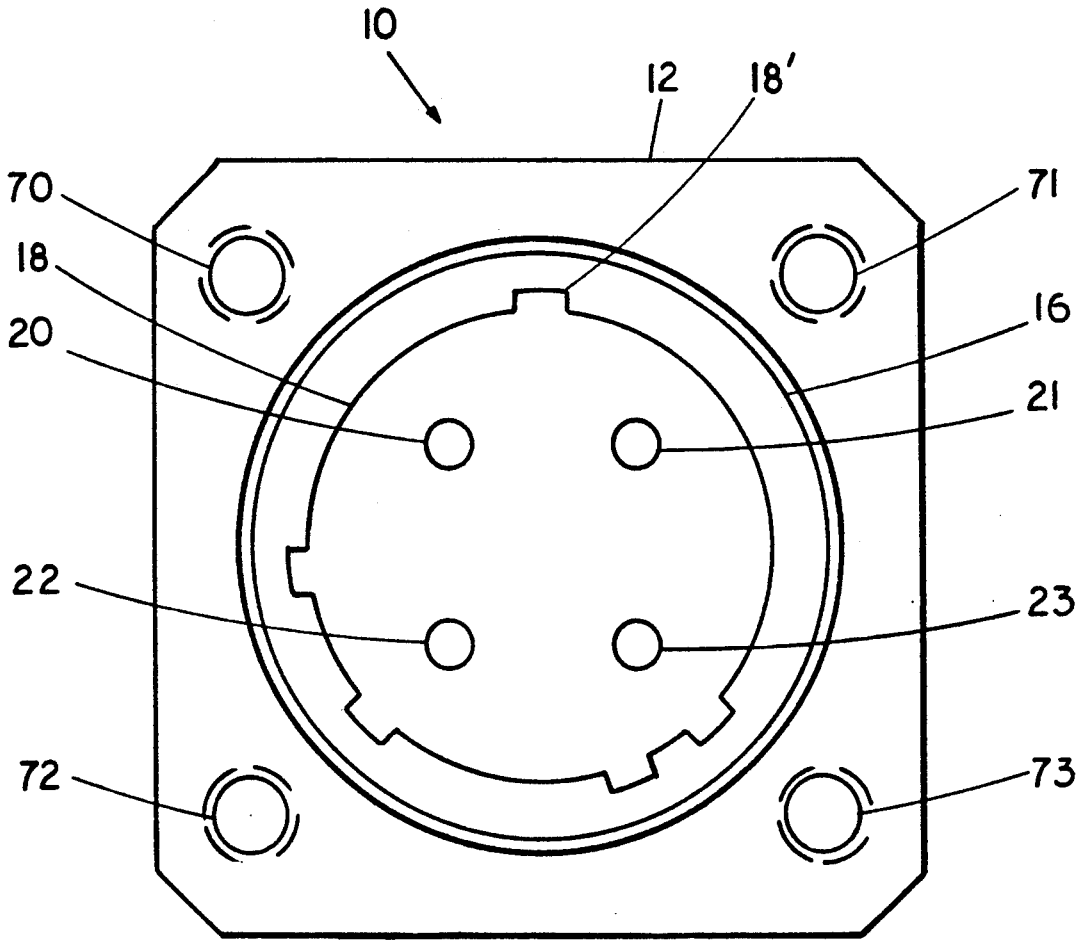
FIG. 2 is an end view along line 2—2 in FIG. 1 of a releasable housing shown in FIG. 1 in accordance with the invention.

FIG. 2 is an end view along line 2—2 in FIG. 1 of releasable housing 12. Threaded passage walls 70, 71, 72 and 73 are adapted to receive bolts, which also extend through aperture walls 38, 40, 42 and 44 of permanent housing 14 (shown in FIG. 12) to connect the housings. The inner contacts 20, 21, 22 and 23 are supported by insulator 18. Inner contacts 20 and 22 extend through insulator 64 into outer contacts 58 and 60, as described above.

Figure 3:
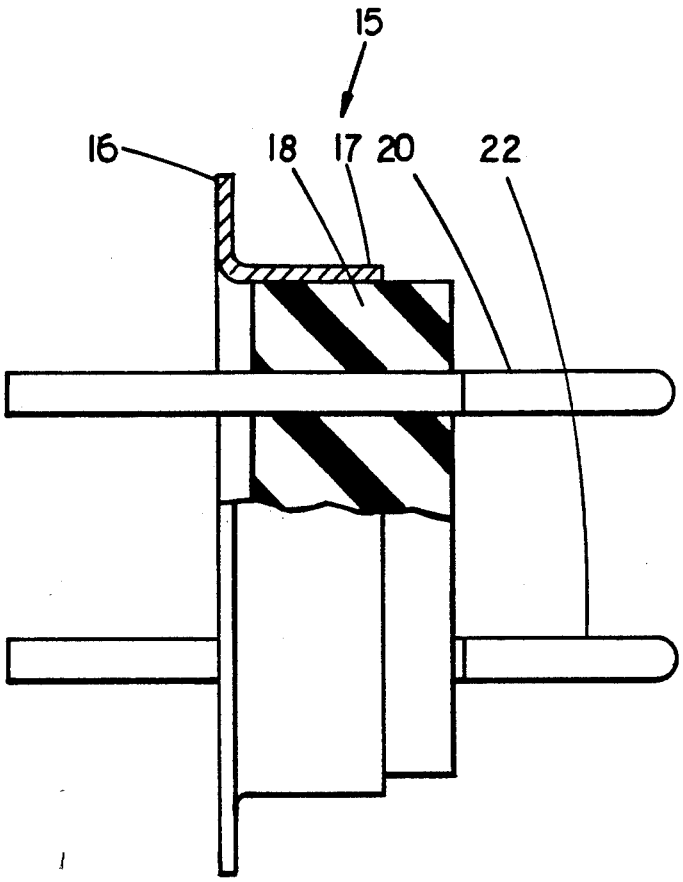
FIGS. 3 and 4 are a cross-sectional side view and end view of an insulator and a collar in accordance with the invention.
Figure 4:
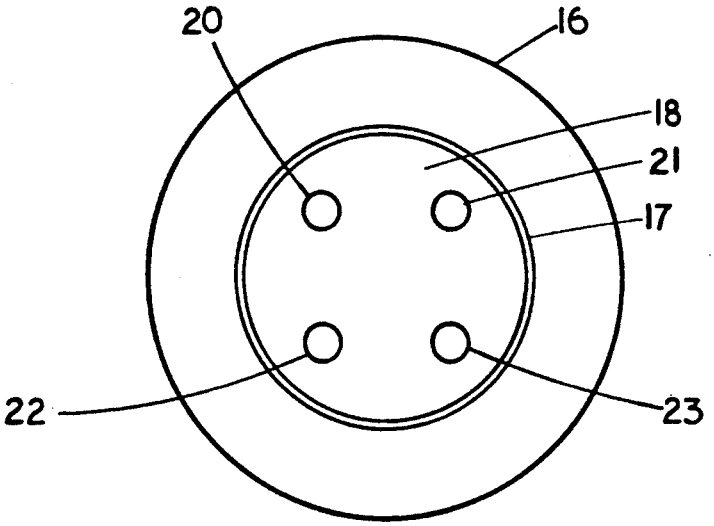
Figure 5:
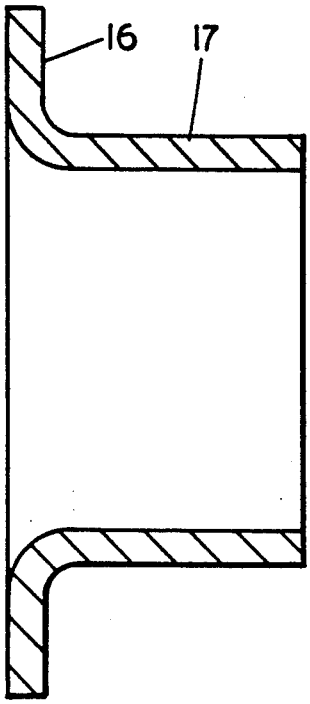
FIGS. 5 and 6 are an end view and cross-sectional side of a collar in accordance with the invention.
Figure 6:
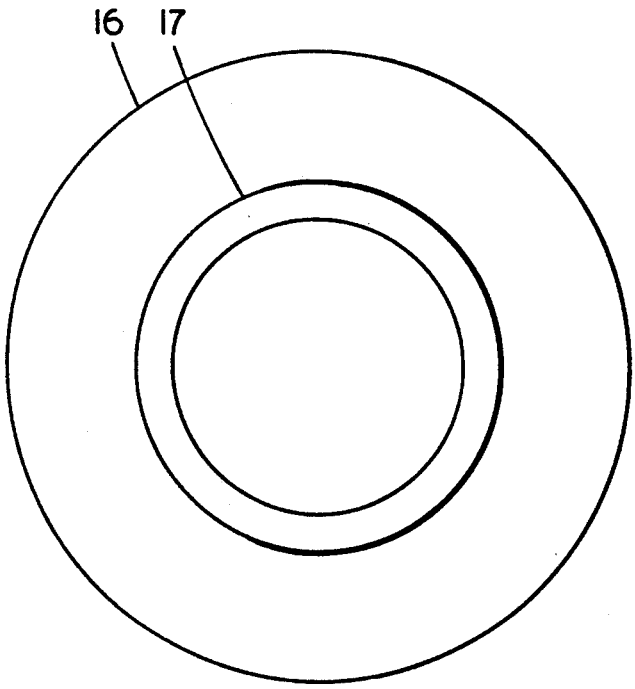

FIGS. 3 and 4 show side and end views respectively of a disposable connector 15 having inner contacts 20, 21, 22, and 23 supported by the insulator 18 in the collar 17. The cylindrical collar 17 includes a flange 16 as shown in side and end views in FIGS. 5 and 6 respectively. The collar 17 is adapted to support insulator 18 as shown in FIG. 1. Preferably, the collar is made of a malleable metal such as nickel.

Figure 7:
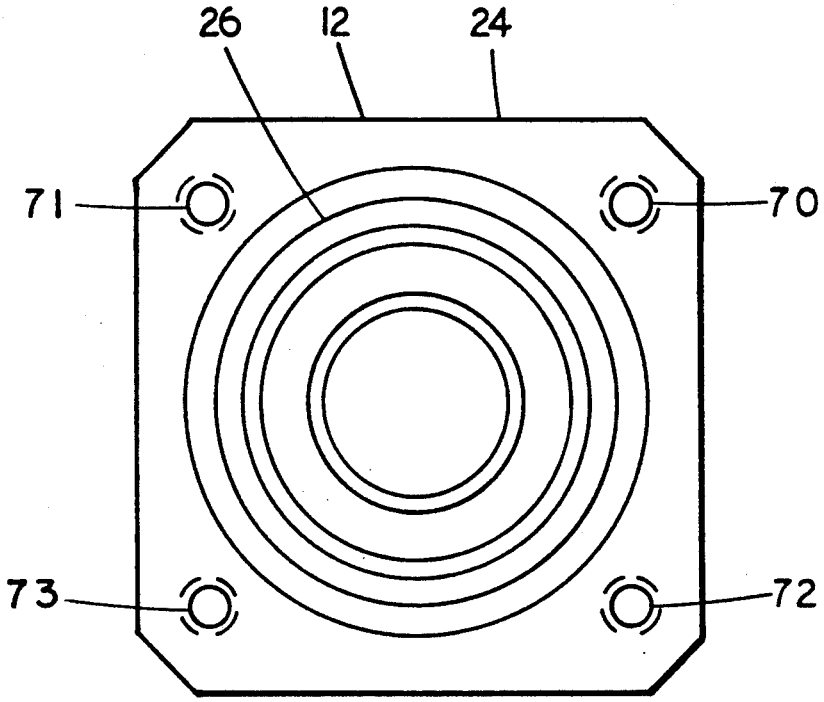
FIGS. 7 is an end view along line 7—7 in FIG. 1 side view of a releasable housing in accordance with the invention.
Figure 8:
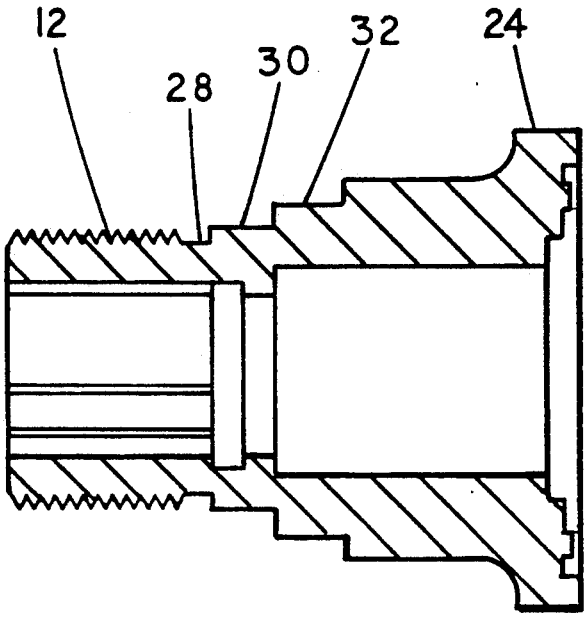
FIG. 8 is a cross-sectional side view of a releasable housing in accordance with the invention.
Figure 9:
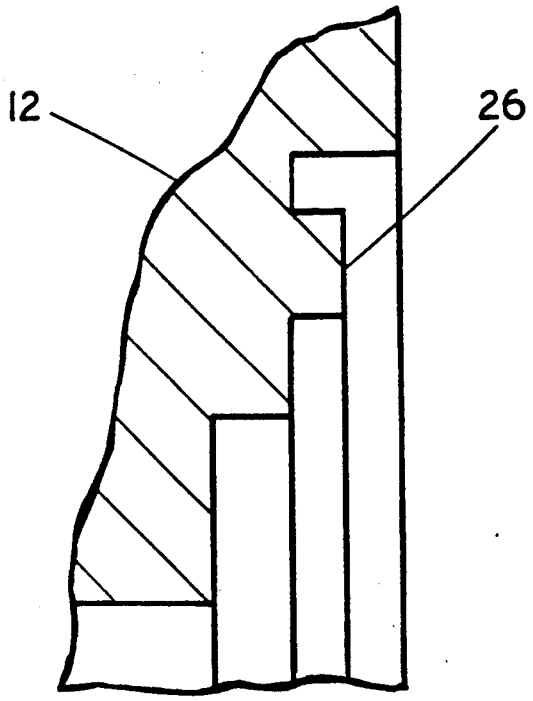
FIG. 9 is a partial side view of a releasable housing shown in FIGS. 7 and 8 showing a laterally extending tongue.
Figure 10:
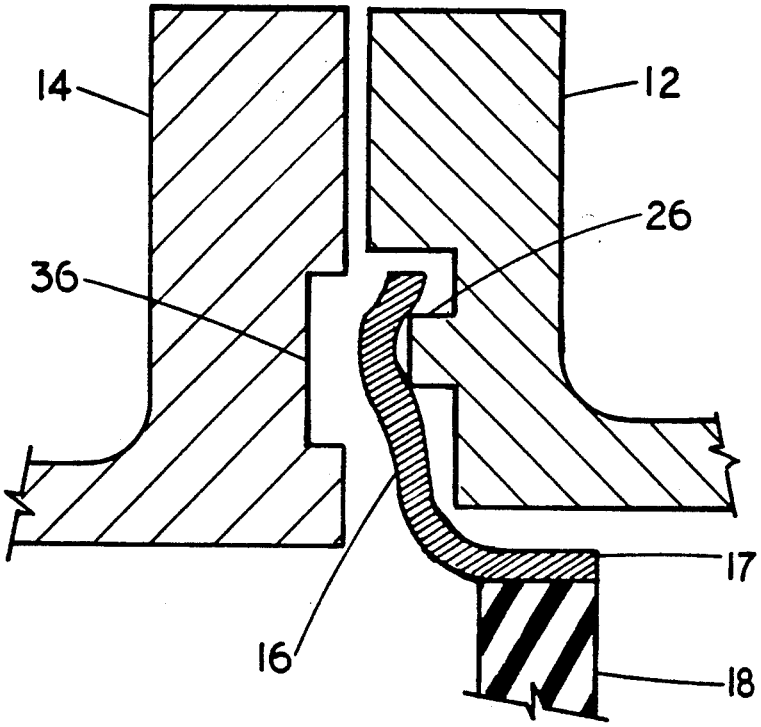
FIG. 10 is a partial side view of the housings showing the tongue and groove adjacent to the sealing flange as deformed by sealing in accordance with the invention.
Figure 11:
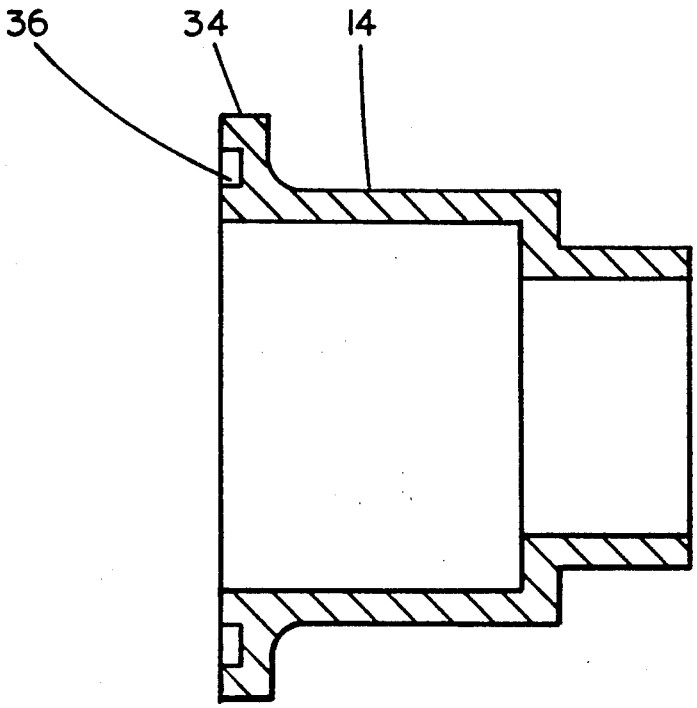
FIGS. 11 is a side view of the permanent housing in accordance with the invention.
Figure 12:
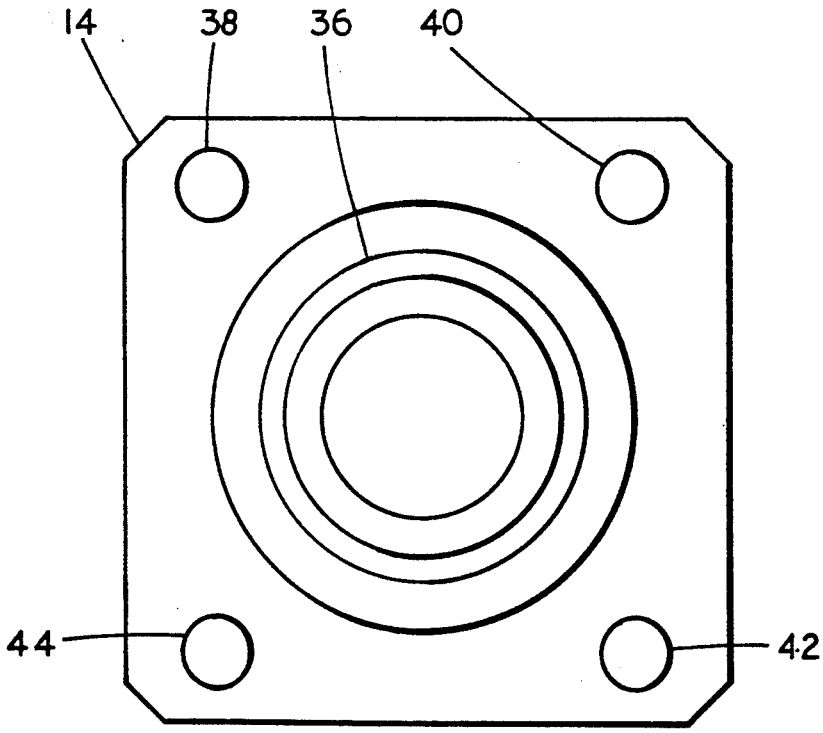
FIG. 12, is an end view along line 12—12 in FIG. 1 of the permanent housing in accordance with the invention.

FIG. 7 is an end view along line 7—7 in FIG. 1 of releasable housing 12. A side view of the releasable housing 12 is shown in FIG. 8. The tongue 26 extends from flange 24 as shown in FIG. 9. FIG. 10 shows the tongue and groove adjacent to the flange 16 during the sealing process. The tongue 26 is adapted to fit into the groove 36 of permanent housing 14 shown in a side and an end view in FIGS. 11 and 12 respectively. The apertures 38, 40, 42 and 44 are adapted to receive the bolts which extend through the threaded passage walls 70, 71, 72 and 73. Upon tightening bolts into the threaded passages, the tongue 26 forces the adjacent portion of the flange 16 into the groove 36 of the permanent housing 14 hermetically sealing the housings 12 and 14 together. The conductors 54 and 56 are connected to counter 80 which is connected to display 84 by a cable of conductors 82. Thus, the signal from the speed sensor 51 is conducted to counter 80 and the output thereof displayed by display 84.

In accordance with the invention, hermetic sealing electrical contacts in housings, is accomplished by positioning a connector between a first and a second housing. As shown in the FIGS., the connector has an electrically insulating body, at least one electrically conducting contact, and a collar having a malleable flange. The flange is positioned between the tongue and groove of the permanent and releasable housings.

When a repair inside of the housings is needed, for example because of improper connection or disconnection of the wires, the housings are unbolted. After the repair is made, a replacement connector, as shown in FIG. 3, is used in place of the original connector. The housings are repositioned to hermetically seal along said replacement connector's sealing flange.

Figure 13:
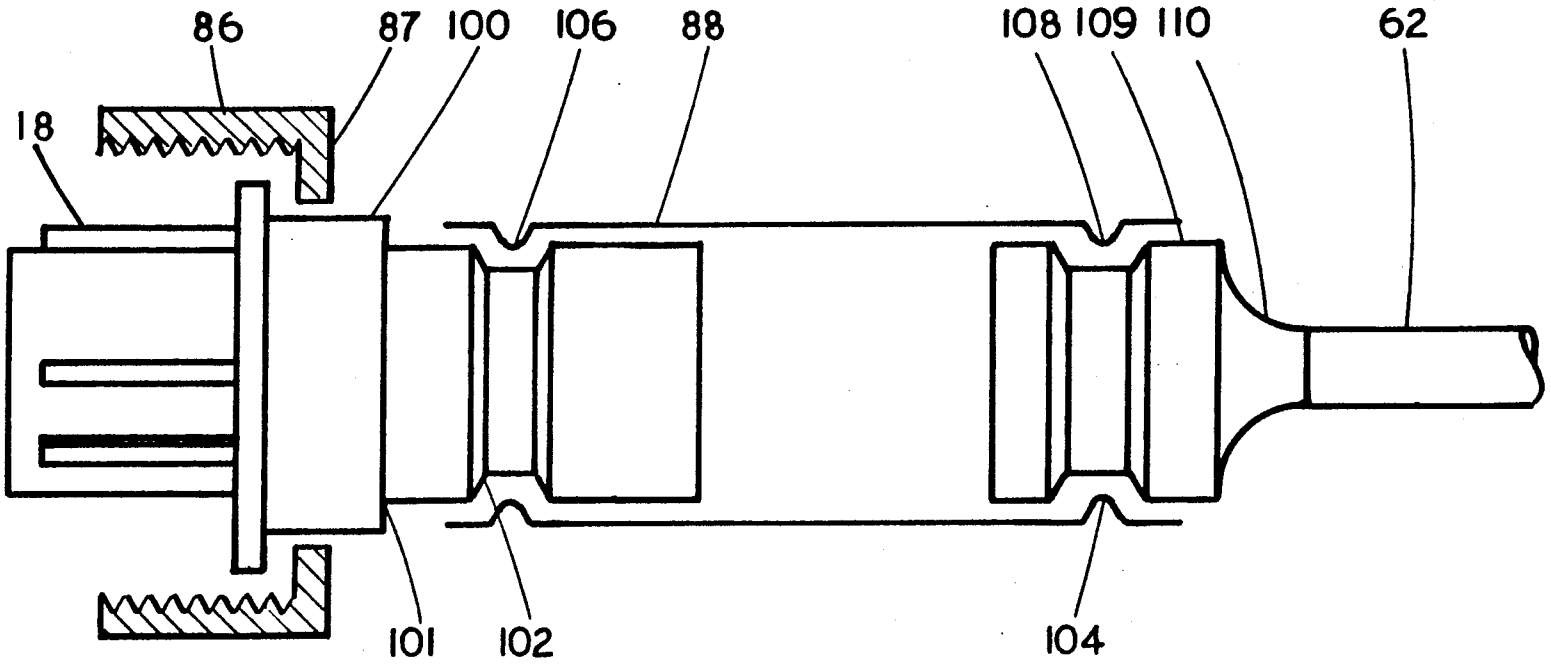
FIG. 13 is a partial cross-sectional side view of the cable (or harness) connector backshell in accordance with the invention.

A linear cable (or wiring harness) connector sleeve 88 is shown in FIG. 13. The flange 87 of nut 86 overlaps the flange of connector housing 100. The connector housing 100 has shoulder 101 and a groove wall 102. The sleeve 88 includes bend 106 which fits into the groove enclosed by groove wall 102. Groove wall 104 encloses a groove into which fits bend 108 of sleeve 88. Bend 108 holds sleeve 88 to cable adaptor 110. Prior to forming bends 106 and 108, one end of sleeve 88 is positioned even with the side of flange 109 of adaptor 110, and the other end is positioned against the shoulder 101 of connector housing 100.

The sleeve 88 may be bent by tack welding and rolling, magnetic pulse forming or other suitable methods that physically deform the sleeve into the grooves. Beneficially the sleeve cavity is maximized by not having shoulders protrude therein. Replacement of the sleeve is generally required each time it is removed because of deformation of the sleeve, which occurs during removal. Thus, unauthorized removal of the sleeve is readily detectable.

Figure 14:
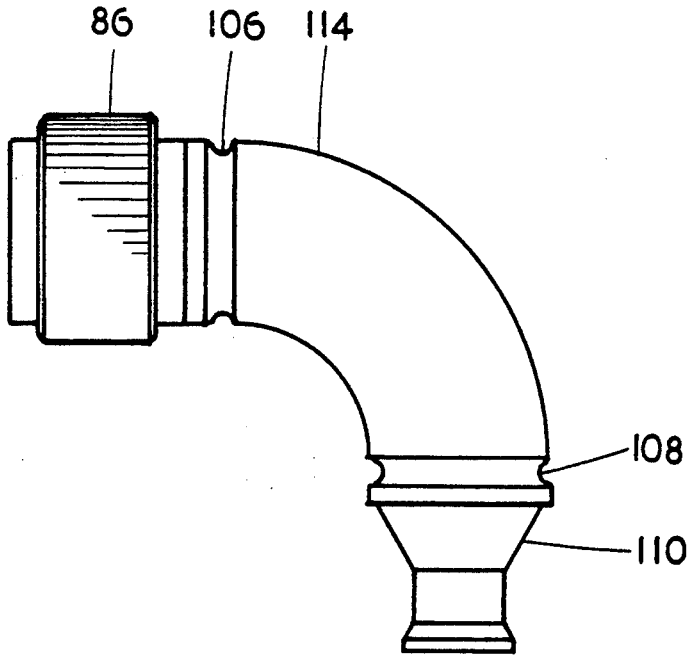
FIG. 14 is a side view of an elbow cable connector backshell in accordance with the invention.

FIG. 14 shows an elbow sleeve 114 having crimped bends 106 and 108. The bend 106 extends into the groove adjacent wall 102 as shown in FIG. 13 and holds sleeve 114 to the connector housing adjacent to nut 86. The crimped bend 108 extends into the groove adjacent to wall 104 and holds sleeve 114 to the cable adaptor 110.

Figure 15:
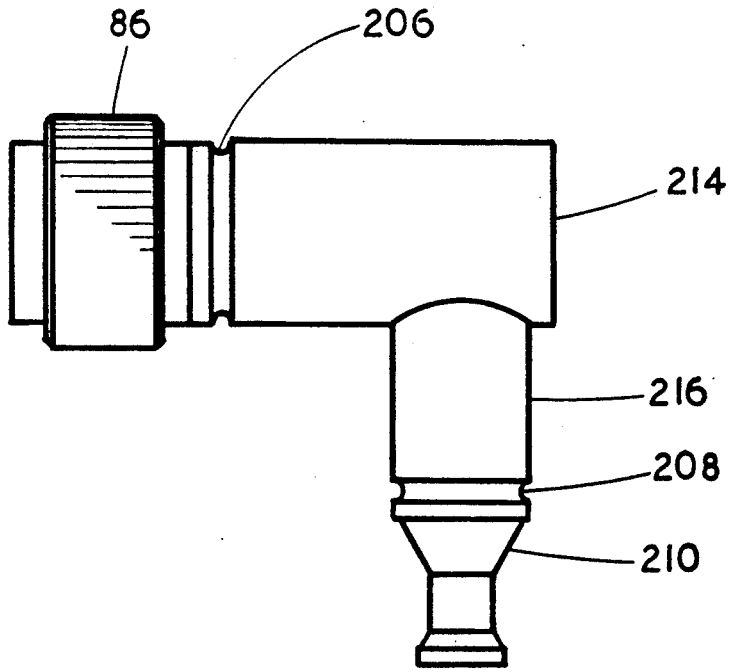
FIG. 15 is a side view of an elbow cable connector backshell having two diameters in accordance with the invention.

FIG. 15 shows an elbow (angular) sleeve having a larger diameter section 214 and a smaller diameter section 216. Bend 206 extends into a groove 102 as shown in FIG. 13 and holds the larger diameter section of the cable connector to the connector housing adjacent to nut 86. The bend 208 extends into a groove therebeneath and holds the smaller diameter section 216 of the sleeve to cable adaptor 210.

The hermetic seal is effective to prevent leakage. A helium mass spectrometer is used for leak detection following temperature and pressure cycles such as those shown in the Table below.

LEAKAGE TEST SEQUENCE

In sequence 1 of the Table, the high pressure sealing test is started at 70° F. and 60 psig . The pressure inside the conduit 50 (chamber) is increased in increments of 40 psi until reaching 780 psig to test the sealing of the connector flange 16. This pressure is maintained for 30 minutes. A change in gauge pressure check from the beginning to the end of the 30-minute holding period is an indication of a leakage through the seal at flange 16. Then the pressure inside the conduit is lowered to 0 psig.

This procedure is then repeated at the temperatures shown in the Table below for sequences 2–16 of the Table to complete the testing for leakage.

TABLE

| LEAKAGE TEST SEQUENCE | |
|---|---|
| PRESSURE SEQUENCE NUMBER | CONDUIT TEMPERATURE °F. |
| 1 | 70 |
| 2 | 130 |
| 3 | 180 |

TABLE-continued

| LEAKAGE TEST SEQUENCE | |
|---|---|
| PRESSURE SEQUENCE NUMBER | CONDUIT TEMPERATURE °F. |
| 4 | 230 |
| 5 | 280 |
| 6 | 330 |
| 7 | 380 |
| 8 | 430 |
| 9 | 480 |
| 10 | 530 |
| 11 | 580 |
| 12 | 630 |
| 13 | 680 |
| 14 | 730 |
| 15 | 780 |
| 16 | 850 |

Preferably, the sealed housing remains hermetically sealed to at least 500° F. and 600 psig. More preferably, the sealed housing remains hermetically sealed to at least 600° F. and 700 psig.

Other features, advantages and specific embodiments of this invention will become readily apparent to those exercising ordinary skill in the art after reading the foregoing disclosures. In this regard, while specific embodiments of this invention have been described in considerable detail, variations and modifications of these embodiments can be effected without departing from the spirit and scope of the invention as disclosed and claimed.

What is claimed is:

1. A cable connecting system, comprising:

a cable connector housing, a connector sleeve, a cable adaptor and a cable, said cable connector housing having a cable connector housing groove, said cable adaptor having a cable adaptor groove, said connector sleeve having first and second end portions, said first end portion of said connector sleeve being bent into said cable connector housing groove, said second end portion of said connector sleeve being bent into said cable adaptor groove, said cable adaptor being connected to said cable, said sleeve being adapted to be substantially deformed during removal of said first and second end portions of said sleeve from said grooves whereby said removal is readily detectable.

2. The system of claim 1 wherein said sleeve further comprises a first section and a second section, said first section having a first diameter and said second section having a second diameter.

3. The system of claim 1, wherein the connector housing further comprises:

an electrical insulator, at least one electrically conducting contact, sealing flange means, and a first and a second housing, said sealing flange means having a malleable sealing flange, said second housing comprising a rigid member having apertures therethrough adapted to receive said contact, said insulator being supported by said sealing flange, said contact being supported by said insulator, said sealing flange extending radially outward from said insulator, each of said housings having an end flange which extends radially from the central axis of the housing, at least one of said housing flanges having a groove in the side thereof, the other of said housing flanges having a tongue in the side thereof, said sealing flange being positioned between said tongue and said groove.

4. The system of claim 1 wherein said connector sleeve is deformed into said connector housing groove by tack welding and rolling.

5. The system of claim 1 wherein said sleeve further comprises a first section and a second section and said first section and said second section are joined at an angle other than 180 degrees.

6. The system of claim 5 wherein said first and said second sections are formed at about a 90 degree angle.

7. The system of claim 1 wherein the connector housing further comprises:

an electrical insulator, at least one electrically conducting contact, sealing flange means, and a first and a second housing, said sealing flange means having a malleable sealing flange, said first housing comprising a resilient member having at least one aperture therethrough adapted to receive said contact, said insulator being supported by said sealing flange, said contact being supported by said insulator, said sealing flange extending radially outward from said insulator, each of said housings having an end flange which extends radially from the central axis of the housing, at least one of said housing flanges having a groove in the side thereof, the other of said housing flanges having a tongue in the side thereof, said sealing flange being positioned between said tongue and said groove.

8. The system of claim 7 wherein said contact is connected to a sensor positioned within a turbine engine.

9. The system of claim 7 wherein said sealing flange is made of malleable metal and extends radially outward from a cylindrical collar.

10. The system of claim 7 wherein said insulator is substantially rigid.

11. A connector system comprising: a cable, a cable connector housing, a connector sleeve, a cable adaptor, said cable connector housing comprising:

an electrical insulator, at least one electrically conducting contact, a sealing flange means, and a first and a second housing means, said sealing flange means having a malleable sealing flange, said connector sleeve being bent into a groove in said cable connector housing groove.

said connector sleeve being bent into a groove in said cable adaptor, said cable adaptor being connected to said cable, each of said housing means having an end flange which extends radially from the central axis of the housing means, at least one of said housing means flanges having a groove in the side thereof, the other of said housing means flanges having a tongue in the side thereof, said sealing flange being positioned between said tongue and said groove, said sealing flange forming a hermetic seal between said housing means flanges, said housing means flanges being bolted together, said insulator being supported by said sealing flange means, said contact being supported by said insulator, said sealing flange extending radially outward from said insulator.

12. A method of cable connection, comprising:

positioning a connector between a first and a second sealing housing, said connector comprising an electrical insulator, at least one electrically conducting contact, and a malleable sealing flange extending radially outward from a collar, said collar supporting said insulator, said contact being supported by said insulator, each of said sealing housings having an end face flange which extends outwardly from the central axis of the sealing housing, one said end face having a groove therein, the other said end face having a tongue therein, said sealing flange extending between said tongue and said groove, whereby upon being fastened together said first sealing housing and said second sealing housing are hermetically sealed at said sealing flange, said insulator being substantially rigid, providing a resilient insulator, said resilient insulator being positioned within one of said housings, providing a cable connecting system, said cable connecting system comprising a cable connector housing, a connector sleeve, a cable adaptor and a cable, said connector sleeve being bent into a groove in said cable connector housing, said connector sleeve being bent into a groove in said cable adaptor, said cable adaptor being connected to said cable.

13. The method of claim 12 wherein said electrical insulator comprises ceramic.

14. The method of claim 12 wherein said sealing flange comprises metal.

15. The method of claim 12 wherein said contact is electrically connected to a sensor in a turbine engine.

16. The method of claim 12 further comprising separating said first and said second housing, replacing said connector with a replacement, connector, said replacement connector having a replacement electrical insulator, at least one electrically conducting replacement contact and a replacement malleable sealing flange and a replacement flange body, repositioning said first housing and said second housing to hermetically seal along said replacement sealing flange.

17. The method of claim 12 further comprising:

raising the temperature within said hermetically sealed housings to at least 500° F.

18. The method of claim 12 further comprising:

raising the temperature within said hermetically sealed housings to at least 600° F.

19. The method of claim 12 further comprising providing a cable connector housing, a connector sleeve, a cable adaptor and a cable, connecting said cable connector housing to said one of said sealing housings, connecting said connector sleeve to said cable connector housing and to said cable adaptor, connecting said adaptor to said cable.

* * * * *